United States Patent [19]

Landis

[11] Patent Number: 4,729,510

[45] Date of Patent: Mar. 8, 1988

[54] COAXIAL SHIELDED HELICAL DELAY LINE AND PROCESS

[75] Inventor: Richard C. Landis, Shelton, Conn.

[73] Assignee: ITT Corporation, New York, N.Y.

[21] Appl. No.: 671,272

[22] Filed: Nov. 14, 1984

[51] Int. Cl.[4] ..... H01P 9/02

[52] U.S. Cl. ..... 333/162; 336/200; 29/825; 29/829; 29/600; 174/68.5

[58] Field of Search ..... 333/162, 163, 161, 156, 333/140; 315/315, 3.6, 39.3, 39; 29/600, 602 R, 825, 828, 829, 842; 336/200; 174/68.5; 156/150, 901

[56] References Cited

U.S. PATENT DOCUMENTS

| | | | |
|---|---|---|---|
| 2,832,935 | 4/1958 | Tank | 373/140 |
| 2,860,308 | 11/1958 | Bales | 333/116 |
| 2,926,317 | 2/1960 | Blitz | 333/238 |
| 2,995,806 | 8/1961 | Allison et al. | 333/239 X |
| 3,157,847 | 11/1964 | Williams | 29/600 X |
| 3,199,054 | 8/1965 | Holland et al. | 333/163 |
| 3,221,274 | 11/1965 | Vaz | 333/115 |
| 3,225,351 | 12/1965 | Chatelain et al. | 333/238 X |
| 3,243,498 | 3/1966 | Allen et al. | 174/68.5 |
| 3,258,724 | 6/1966 | Walsh et al. | 333/238 |
| 3,292,115 | 12/1966 | La Rosa | 333/239 |
| 3,358,248 | 12/1967 | Saad | 333/115 |
| 3,368,112 | 2/1968 | Hellgren | 333/238 X |
| 3,376,463 | 4/1968 | Feinstein | 315/3.5 |
| 3,398,232 | 8/1968 | Hoffman | 333/238 X |
| 3,416,102 | 12/1968 | Hamlin | 333/115 |
| 3,436,690 | 4/1969 | Golant et al. | 333/156 |
| 3,461,347 | 8/1969 | Lemelson | 336/200 X |
| 3,484,725 | 12/1969 | Sobotka | 333/161 |
| 3,496,492 | 2/1970 | Kurzl et al. | 333/116 |
| 3,504,223 | 3/1970 | Orr et al. | 315/3.5 |
| 3,517,271 | 6/1970 | Edmonds et al. | 361/414 |
| 3,543,194 | 11/1970 | Kassabgi | 333/156 |
| 3,555,461 | 1/1971 | Ralph et al. | 333/156 |
| 3,613,230 | 10/1971 | Griff | 174/36 X |
| 3,617,952 | 11/1971 | Beech | 333/116 |
| 3,666,983 | 5/1972 | Krah et al. | 333/162 X |
| 3,696,433 | 10/1972 | Killion et al. | 333/238 X |
| 3,701,958 | 10/1972 | Jaag | 333/185 |
| 3,768,048 | 10/1973 | Jones, Jr. et al. | 333/238 |
| 3,837,074 | 9/1974 | Griff | 174/36 X |
| 3,900,806 | 8/1975 | Caroli | 333/156 X |
| 3,922,479 | 11/1975 | Older et al. | 174/68.5 |
| 3,924,204 | 12/1975 | Fache et al. | 333/21 R |
| 4,288,761 | 9/1981 | Hopfer | 333/116 |
| 4,313,095 | 1/1982 | Jean-Frederic | 333/116 |
| 4,342,143 | 8/1982 | Jennings | 336/200 X |
| 4,367,450 | 1/1983 | Carillo | 336/200 |
| 4,375,054 | 2/1983 | Pavio | 333/116 |
| 4,439,748 | 3/1984 | Drogone | 333/239 |
| 4,459,568 | 7/1984 | Landt | 333/116 |
| 4,465,984 | 8/1984 | McDowell | 333/161 X |
| 4,488,125 | 12/1984 | Gentry et al. | 333/1 |

FOREIGN PATENT DOCUMENTS

| | | | |
|---|---|---|---|
| 0009348 | 1/1977 | Japan | 333/33 |
| 0085902 | 7/1981 | Japan | 333/239 |
| 0184301 | 11/1982 | Japan | 333/222 |
| 772528 | 4/1957 | United Kingdom | 29/602 R |

OTHER PUBLICATIONS

Chalman et al.; "Multiple Function of Blind Copper Vias in Polyimide Multilayer Structure", *Fourth Int'l Electronic Package Conf;* Balt. Md; 29–31, Oct. 84.

Collenberger et al.; "Method for Fabricating Precision Waveguide Sections"; *NBS Technical Note,* 536; pp. 10–13, Jun. 1970.

Ragan, Cruogles L.; *Microwave Transmission Circuits;* McGraw Hill Book Company, N.Y., N.Y., 1948, pp. 349, 347–348.

*Primary Examiner*—Eugene R. LaRoche
*Assistant Examiner*—Benny T. Lee
*Attorney, Agent, or Firm*—Peter A. Abruzzese

[57] ABSTRACT

A substrate is disclosed with a shielded delay line imbedded therein to obtain a delay of a preselected duration. The delay line comprises a conductor formed in the shape of a helical coil to reduce its overall dimension. The substrate is formed by superimposing a plurality of layers of conductive and/or dielectric material to form a preselected profile.

4 Claims, 14 Drawing Figures

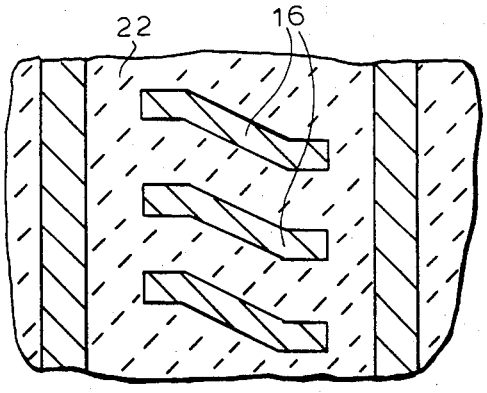
FIG.4
FIG.5
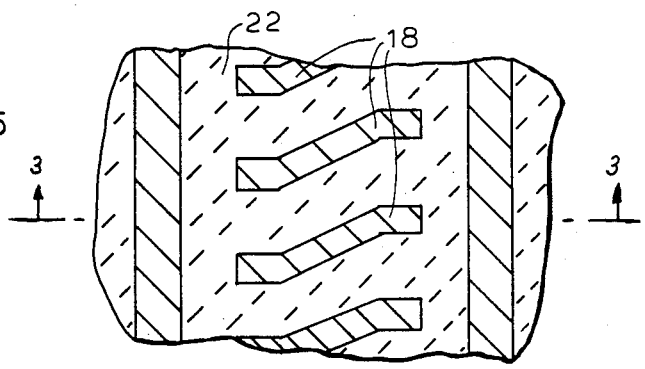
FIG. 3a
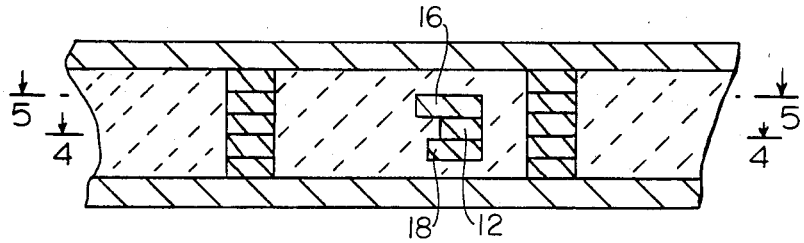
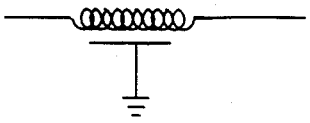
FIG.6

COAXIAL SHIELDED HELICAL DELAY LINE AND PROCESS

BACKGROUND OF THE INVENTION

1. Field of Invention

This invention pertains to a substrate with a shielded delay line and to a method for making the same.

2. Description of the Prior Art

In various electronic circuits it is frequently desirable to provide a means or delaying certain signals for a predetermined length of time. For circuits operating at very high frequency, where the required delay is in the microsecond or sub-microsecond range, the delay means comprises a conductor having a preselected length. In order to reduce the overall size of the delay means the conductor is usually formed in the shape of an axially coiled spiral.

Usually the various electronic devices used in the electronic circuits are mounted on a printed circuit board. However it is fairly difficult to mount the above-mentioned delay coil on a circuit board because of its size and fragility. Frequently, the coil is encapsulated in a dielectric material to give it rigidity, however this process is expensive. Furthermore, at high frequency the conductor must be shielded to eliminate noise or extraneous signals. This shielding even further complicates the construction of the delay coil and the manner of mounting it to a printed circuit board.

OBJECTIVES AND SUMMARY OF THE INVENTION

In view of the above, it is a principal objective of the present invention to provide a delay means which may be easily interfaced with electronic devices mounted on a printed circuit board.

A further objective is to provide a delay means which can be provided as part of said printed circuit board.

Another objective is to provide a delay means which is shielded to eliminate noise.

Other objectives and advantages shall become apparent from the following description of the invention.

A delay line, according to this invention, comprises a coil of axially spaced turns, and formed of a plurality of conductive strips. The strips may be overlaid by using standard photomasking techniques. A dielectric material is used between the strips. The delay line may also comprise a shield co-extensive with said coil and formed simultaneously therewith.

FIG. *3a* shows an end cross sectional view of a delay line formed of a plurality of superimposed layers;

FIGS. *3b–3i* show the method of constructing the delay line of FIG. *3a;*

FIG. 4 shows a top cross-sectional view of the delay line taken along lines 4—4 in FIG. *3a;*

FIG. 5 shows a top cross-sectional view of the delay line taken along lines 5—5 on FIG. *3a;* and FIG. 6 shows an electrical equivalent for the delay line constructed in accordance with the invention.

DETAILED DESCRIPTION OF THE INVENTION

Figure 1:
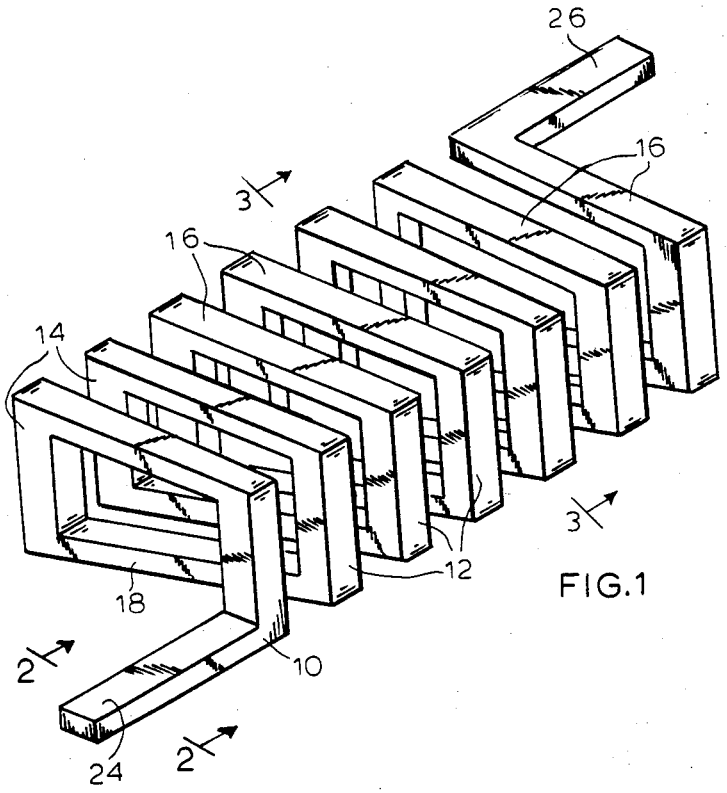
FIG. 1 shows an isometric view of the conductor formed in the shape of a spiral to form a delay line.
Figure 2:
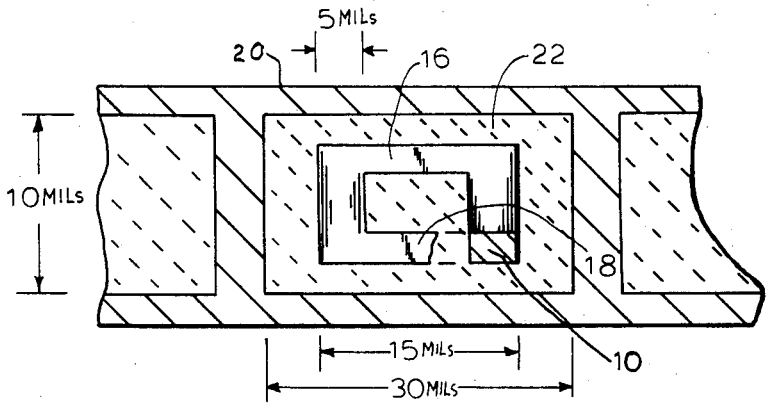
FIG. 2 is an end view of a substrate with a shielded delay line.
Figure 3B:
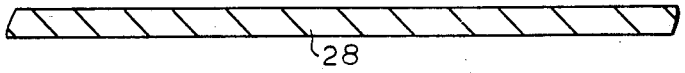
Figure 3C:
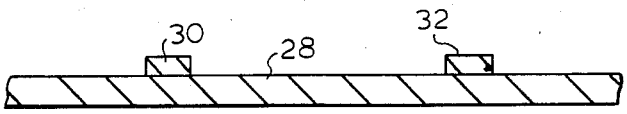
Figure 3D:
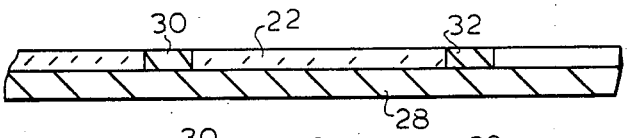
Figure 3E:
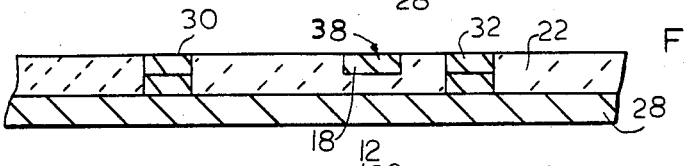
Figure 3F:
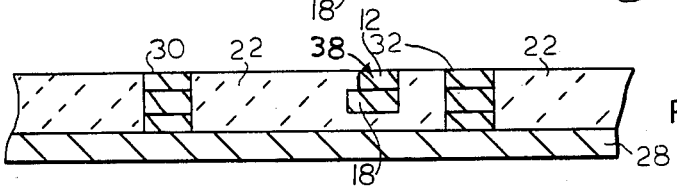
Figure 3G:
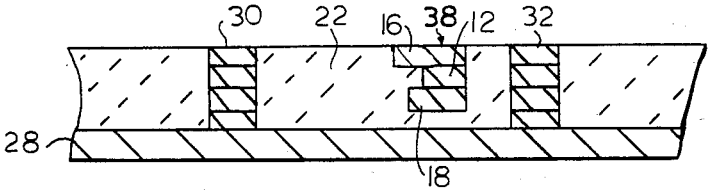
Figure 3H:
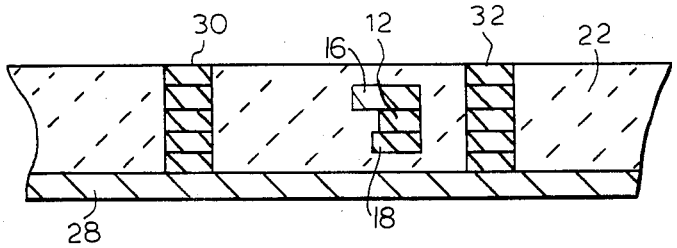
Figure 3I:
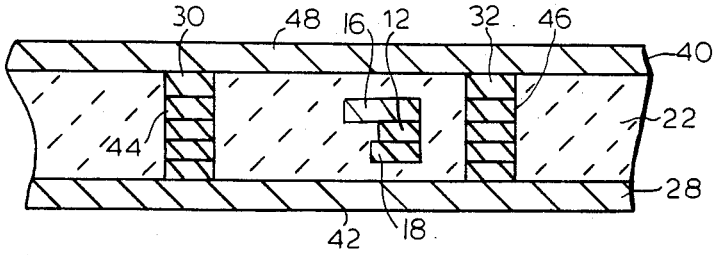

According to this invention and as shown in FIG. 1 a delay line comprises a conductor 10 which is formed as a helical coil and imbedded in the substrate for mounting various electronic devices. For reasons that shall become apparent below, the helical coil is formed of a plurality of substantially straight elements such as vertical elements 12 and 14 which are interconnected by horizontal elements 16 and 18. Preferably as shown in FIG. 2 a shield 20 is formed around the conductor 10 as shown in FIG. 2 and co-extensive therewith. The spaces between shield 20 and conductor 10 and between the elements of conductor 10 are filled with a dielectric material 22.

Free ends 24 and 26 of the conductor are connected to a shielded conductor or are provided with a pad for connection with elements disposed outside the substrate.

In my copending and commonly assigned application entitled "MICRO-COAXIAL SUBSTRATE" Ser. No. 671,276 filed on even date herewith and incorporated herein by reference, I disclose a method of forming a substrate with an imbedded shielded conductor. The same method may be used to form a substrate with the delay unit of FIGS. 1 and 2 as described below.

Basically, the substrate is formed by superimposing a plurality of layers to obtain the desired conductor profile as shown in FIG. *3a.* Initially a first layer 28 is made of a conductive material (see FIG. *3b*). This first layer shall form a first ground plane for the conductor 10. The second layer is formed by applying two conductive strips 30, 32 on the base (FIG. *3c*) and then applying a dielectric material 22 such as polyimide evenly across layer 28 (FIG. *3d*). The third, fourth and fifth layers (FIGS. *3e, 3f,* and *3g*) also include portions 38 of conductive material which are shaped to form parts of coil 10. The parts of coil 10 formed by portions 38 include free ends 24 and 26, vertical elements 12 and 14, and horiziontal elements 16 and 18. After the fifth layer (FIG. *3g*) another layer is applied which is identical to the second layer of FIG. *3d.* After the sixth layer of FIG. *3h,* a second conductive layer 40 is applied (FIG. *3i*). This layer provides a second ground plane. It is obvious from the Figures that strips 30, 32 and layers 28 and 40 cooperate to form a rectangular shield around conductor 10, with a base 42, two side walls 44, 46 and a top 48. As can be seen in FIGS. 4 and 5 the horizontal elements 16, 18 comprise straight strips which extend diagonal from vertical elements 12 to vertical elements 14 to form the helical coil of FIG. 1.

After the last layer of FIG. *3i* is applied, other layers may be added as required to form a printed circuit board. Furthermore, it should be understood that FIGS. *3a–i* show just the portion of the substrate incorporating the delay line. Other portions may be dedicated for shielded conductor described in the above-mentioned application as well as various other imbedded circuit elements such as a Resonator as disclosed in my copending and commonly assigned application entitled "RESONATOR", Ser. No. 671,369 filed on even date herewith and incorporated herein by reference.

For the delay line with the dimensions indicated in FIG. 2 and legs 12 (or 14) being spaced at 10 mils, a delay of 10 microseconds/ft can be obtained.

Obviously numerous modifications can be made to the invention without departing form its scope as defined in the appended claims. For example the substrate may be made using nine layers. Various other geometric configurations may be used to obtain a helical coil.

I claim:

1. A method of forming a shielded delay line embedded in a planar substrate formed of a plurality of superimposed parallel planar layers, said substrate having a major surface thereof lying in a plane parallel to said planar layers, comprising the steps of:

providing a first conductive planar layer as a first of said plurality of superimposed parallel planar layers;

forming a pair of conductive strips in a next one of said superimposed parallel planar layers disposed on said first conductive layer;

placing dielectric material between said conductive strips;

forming a plurality of conductive strips in a plurality of successive ones of said plurality of superimposed parallel planar layers over said next one of said superimposed parallel planar layers;

placing dielectric material between the conductive strips in each of said plurality of successive ones of said plurality of superimposed parallel planar layers;

forming a pair of conductive strips in an additional one of said superimposed parallel planar layers on said plurality of successive planar layers;

depositing dielectric material between said conductive strips of the additional one of said superimposed parallel planar layers; and forming a second conductive planar layer over said additional one of said superimposed parallel planar layers, selected ones of said plurality of conductive strips formed in the plurality of superimposed parallel planar layers being at least partially overlapping and electrically connected and arranged to form a coil having a plurality of turns disposed about and extending along an axis parallel to said plane of said planar substrate, said first and second conductive planar layers, said pairs of conductive strips and others of said plurality of conductive strips being at least partially overlapping and electrically connected and arranged to form a conductive shield spaced from said coil and extending along the length thereof.

2. A delay line, embedded in a planar substrate formed of a plurality of superimposed parallel planar layers, said substrate having a major surface thereof lying in a plane parallel to said planar layers, comprising:

a plurality of conductive portions in said superimposed parallel planar layers;

a coil having a plurality of turns embedded in said substrate and formed about an axis positioned parallel to said plane, each of said turns being formed of at least partially superimposed and electrically connected ones of said conductive portions of said plurality of superimposed parallel planar layers;

dielectric material disposed between the turns of said coil and embedding said coil; and a conductive shield spaced from, extending along the axis of and substantially enclosing said coil, said shield being formed in said substrate by at least partially superimposed and electrically connected other ones of said conductive portions of said plurality of superimposed parallel planar layers.

3. A method of forming a delay line embedded in a planar substrate formed of a plurality of superimposed parallel planar layers, said substrate having a major surface thereof lying in a plane parallel to said planar layers, comprising the steps of:

forming and electrically connecting a plurality of conductive strips arranged in said plurality of planar layers to form a coil having a plurality of turns disposed about an axis parallel to said plane;

placing a dielectric between said turns and embedding said coil; and forming and arranging additional conductive strips in said plurality of planar layers to provide a conductive shield spaced from, extending along the axis of and substantially enclosing said coil.

4. A method of forming a delay line embedded in a planar substrate formed of a plurality of superimposed parallel planar layers, said substrate having a major surface thereof lying in a plane parallel to said planar layers, comprising the steps of:

forming a plurality of conductive strips in a first of said plurality of superimposed parallel planar layers;

forming additional conductive strips in a plurality of additional ones of said plurality of superimposed parallel planar layers, said conductive strips being formed and arranged in at least a partially superimposed and electrically connected manner to form a coil having a plurality of turns disposed about an axis parallel to said plane; and forming additional conductive strips in said plurality of superimposed parallel planar layers, said additional conductive strips being arranged to provide a conductive shield spaced from, substantially enclosing and coextensive with said coil.

* * * * *